US012442373B2

(12) United States Patent
Kuzucan

(10) Patent No.: US 12,442,373 B2
(45) Date of Patent: Oct. 14, 2025

(54) HELICAL COMPRESSOR WITH INTERNAL BEARINGS

(71) Applicant: Willem Isaac Cillie, Bellville (ZA)

(72) Inventor: Mehmet Bora Kuzucan, Oakville (CA)

(73) Assignee: Willem Cillie, Bellville (ZA)

( * ) Notice: Subject to any disclaimer, the term of this patent is extended or adjusted under 35 U.S.C. 154(b) by 0 days.

(21) Appl. No.: 18/009,833

(22) PCT Filed: Jun. 10, 2020

(86) PCT No.: PCT/ZA2020/050030
§ 371 (c)(1),
(2) Date: Dec. 12, 2022

(87) PCT Pub. No.: WO2021/253058
PCT Pub. Date: Dec. 16, 2021

(65) Prior Publication Data

US 2023/0228268 A1 Jul. 20, 2023

(51) Int. Cl.

| | |
|---|---|
| ***F04C 18/16*** | (2006.01) |
| ***F01C 21/02*** | (2006.01) |
| ***F04C 27/00*** | (2006.01) |
| ***F04C 29/00*** | (2006.01) |
| ***F04C 29/02*** | (2006.01) |

(52) U.S. Cl.
CPC ..... *F04C 18/16* (2013.01); *F01C 21/02* (2013.01); *F04C 27/009* (2013.01); *F04C 29/0042* (2013.01); *F04C 29/023* (2013.01); *F04C 2240/20* (2013.01); *F04C 2240/52* (2013.01); *F04C 2240/56* (2013.01); *F04C 2240/603* (2013.01)

(58) Field of Classification Search
CPC .... F04C 18/16; F04C 27/009; F04C 29/0042; F04C 29/023; F04C 2240/20; F04C 2240/52; F04C 2240/56; F04C 2240/603; F01C 21/02
See application file for complete search history.

(56) References Cited

U.S. PATENT DOCUMENTS

| | | | | |
|---|---|---|---|---|
| 4,181,474 | A * | 1/1980 | Shaw | F04C 18/16 417/372 |
| 4,490,102 | A * | 12/1984 | Carre | F04C 18/16 418/178 |
| 5,599,176 | A * | 2/1997 | Reinersmann | F04C 18/16 417/420 |
| 2021/0404715 | A1* | 12/2021 | Klein | F25B 49/005 |
| 2022/0025883 | A1* | 1/2022 | Krampe | F04C 15/008 |
| 2023/0086482 | A1* | 3/2023 | Asfoor | F04C 29/023 418/201.1 |

FOREIGN PATENT DOCUMENTS

| | | | | |
|---|---|---|---|---|
| GB | 2560375 | A * | 9/2018 | F01C 1/08 |
| WO | WO-2020200491 | A1 * | 10/2020 | C09K 5/041 |

* cited by examiner

*Primary Examiner* — Mary A Davis
(74) *Attorney, Agent, or Firm* — Rimon Law, P.C.

(57) ABSTRACT

A compressor which includes a male rotor assembly including an elongate male helical-shaped rotor having an axial cylindrical cavity therethrough, a stationary shaft axially aligned with the male rotor and through the cavity, a housing for housing the male rotor and its associated stationary shaft therein, wherein the shaft is fixed within the housing, and bearing means mounted within the cavity of the male rotor for bearing the friction between the rotor and the shaft as the male rotor rotates about the stationary shaft.

13 Claims, 3 Drawing Sheets

HELICAL COMPRESSOR WITH INTERNAL BEARINGS

TECHNICAL FIELD

This invention relates to a screw type compressor.

SUMMARY OF THE INVENTION

According to the invention, there is provided a compressor including:

a male rotor assembly including:

an elongate male helical-shaped rotor having an axial cylindrical cavity therethrough;

a stationary shaft axially aligned with the male rotor and through the cavity;

a housing for housing the male rotor and its associated stationary shaft therein wherein the shaft is fixed within the housing for preventing rotation thereof relative to the housing;

bearing means mounted within the cavity of the male rotor for bearing the friction between the rotor and the shaft as the male rotor rotates about the stationary shaft;

a female rotor assembly including:

an elongate female helical-shaped rotor having an axial cylindrical cavity therethrough, which is in register with the male rotor;

a stationary shaft axially aligned with the female rotor and through the cavity;

wherein the housing also houses the female rotor and its associated stationary shaft therein wherein the shaft is fixed within the housing for preventing rotation thereof relative to the housing;

bearing means mounted within the cavity of the female rotor for bearing the friction between the rotor and the shaft as the rotor rotates about the stationary shaft;

a drive means for driving either the male or female rotor; and wherein the complementary helix formations define cavities between the male and female formations which capture, drive and compress a fluid substance forward when the rotors are driven.

The rotors may be manufactured from any suitable material including composite alloys, titanium, molybdenum or the like, preferably mild steel. It is to be appreciated that the rotors can be manufactured using any suitable manufacturing process, preferably the rotor is cast and/or machined. An end portion of the male or female rotor may be configured to allow a driving means to be mounted on the rotor. The driving means may be in the form of any suitable driving means and may be in the form of a belt drive, chain drive or motor, preferably a motor. It is to be appreciated that the driving means is mounted directly on the rotor and there are no transmission losses.

The stationary shafts may be manufactured from any suitable material, preferably mild steel.

The housing may be manufactured from any suitable material, preferably steel. The housing may include a fixing means for fixing the shafts to the housing. The fixing means may be configured to fix at least one end of the male or female shaft to the housing, such that the opposing free end thereof may allow the corresponding rotor end be received by the driving means. The fixing means may be in the form of any suitable fixing means, preferably in the form of a lock nut. The lock nut may be configured to allow axial adjustment of the shaft. It is to be appreciated that the housing can be manufactured using any suitable manufacturing process, preferably the housing is cast and/or machined. The housing may define an opening at one end thereof to receive the rotors and shafts therein. The housing may define an aperture at an end opposing the open end thereof for allowing at least a portion of an end of the male or female rotor and shaft to protrude therethrough, such that the driving means can be mounted thereon and it can be received by the driving means, respectively. The housing may further include a cover for covering the rotors and shafts when received by the opening defined by an end of the housing. Securing means, such as bolts, may further be provided for securing the cover to the housing. The cover may define an aperture therethrough for allowing the ends of the shafts, which is to be fixed to the housing, to protrude therethrough. The fixing means may fix the ends of the shafts protruding through the cover to the cover. It is to be appreciated that the fixing means may be tightened and loosened for axial adjustment to adjust the interface clearance between the male and female formations, up to 20 micron which varies according to a diameter and length of the rotors, and to allow positioning of the rotors in the housing to be adjusted. It is to be appreciated that the opposing end of the shaft may be spaced from the housing using shims.

The bearing means may include any suitable bearings such as standard bearing, slide bearings or the like, preferably radial bearings and axial thrust bearings. The axial thrust bearings may be located in a middle portion of the rotor cavity for preventing the rotor from being displaced axially by suction forces. The radial bearings may be located at both ends of rotor cavity for supporting shaft at its ends. A radial bearing may also be located at a portion within the rotor cavity where an outer portion of the rotor is seated in the housing. The bearings means may be spaced axially within the cavity of the rotor for bearing the friction between the rotor and the shaft along an axis thereof. It is to be appreciated that an inner portion of the bearing means is fixed to the stationary shaft to prevent rotation thereof relative to the shaft whereas an outer portion of the bearings means is free to allow rotation thereof relative to the shaft.

Spacers may be mounted on the stationary shaft in-between the bearing means. The spacers may be manufactured from any suitable material including steel, hardened composites or metal composites, preferably steel. The spacers may include inner spacer members and outer spacer members which may be coaxially aligned with one another. It is to be appreciated that the inner spacer members are heat pressed onto the stationary shaft to prevent rotation thereof about the shaft and supports and stiffens the shaft and rotor assembly to lessen bending and to increase resistance to shear forces. It is to be appreciated that ends of the bearing means and ends of the spacers therebetween abutt and bear against one another to support and stiffen the shaft and rotor assembly.

A lubrication system may be in fluid flow communication with the bearing means. The lubrication system may include a lubricant and a lubrication channel defined by the shaft which is in fluid flow communication with the bearing means for directing the lubricant towards the bearing means for lubrication thereof. The lubricant may be in the form of any suitable lubricant and may be selected from the group including, grease, ISO 67 grade lubricant or the like. A lubrication channel may be defined by both ends of the shaft. The channels may be in fluid flow communication with the bearings means. The lubrication channel at one end of the shaft may be an inlet channel allowing the lubricant to flow into the rotor cavity to lubricate the bearing means. The channel at an opposing end of the shaft may be an outlet channel allowing the lubricant to be removed from the rotor cavity.

Seals may be mounted within the rotor cavity for sealing the bearing means and spacers therein. The seals may be in the form of any suitable convention seal. An inner portion of the seal may be fixed to the shaft for preventing rotation thereof about the shaft. An outer portion of the seal may rotate relative to the inner portion of the seal to allow the rotor cavity to remain sealed as the rotor rotates about the shaft. It is to be appreciated that the seals prevent the lubricant from leaking from the rotor cavity. It is to be appreciated that the seals seal the lubricant within the cavity of the rotor such that the lubricant does not come into contact and contaminate the substance, preferably air, that is compressed. It is to be appreciated that the seals also prevent the lubricant, preferably water, lubricating the rotors in a compression chamber of the compressor, from leaking into the rotor cavities.

A coupling arrangement may be mounted on an end of the male or female rotor protruding from the housing which may be sized, shaped and configured for receiving the end of the shaft therein, for coupling the drive means directly to the rotor.

It is to be appreciated that surfaces of the rotor assembly and its components may be plated with a nickel composition, molybdenum, Teflon or similar alloys to protect the surfaces against corrosion caused by water or abrasion thereof by abrasive foreign materials. It is to be appreciated that any suitable process to plate may be used, preferably it is an electroless process.

BRIEF DESCRIPTION OF THE DRAWINGS

A compressor in accordance with the invention will now be described by way of the following, non-limiting examples with reference to the accompanying drawings.

In the drawings.

DETAILED DESCRIPTION OF THE INVENTION

Figure 1:
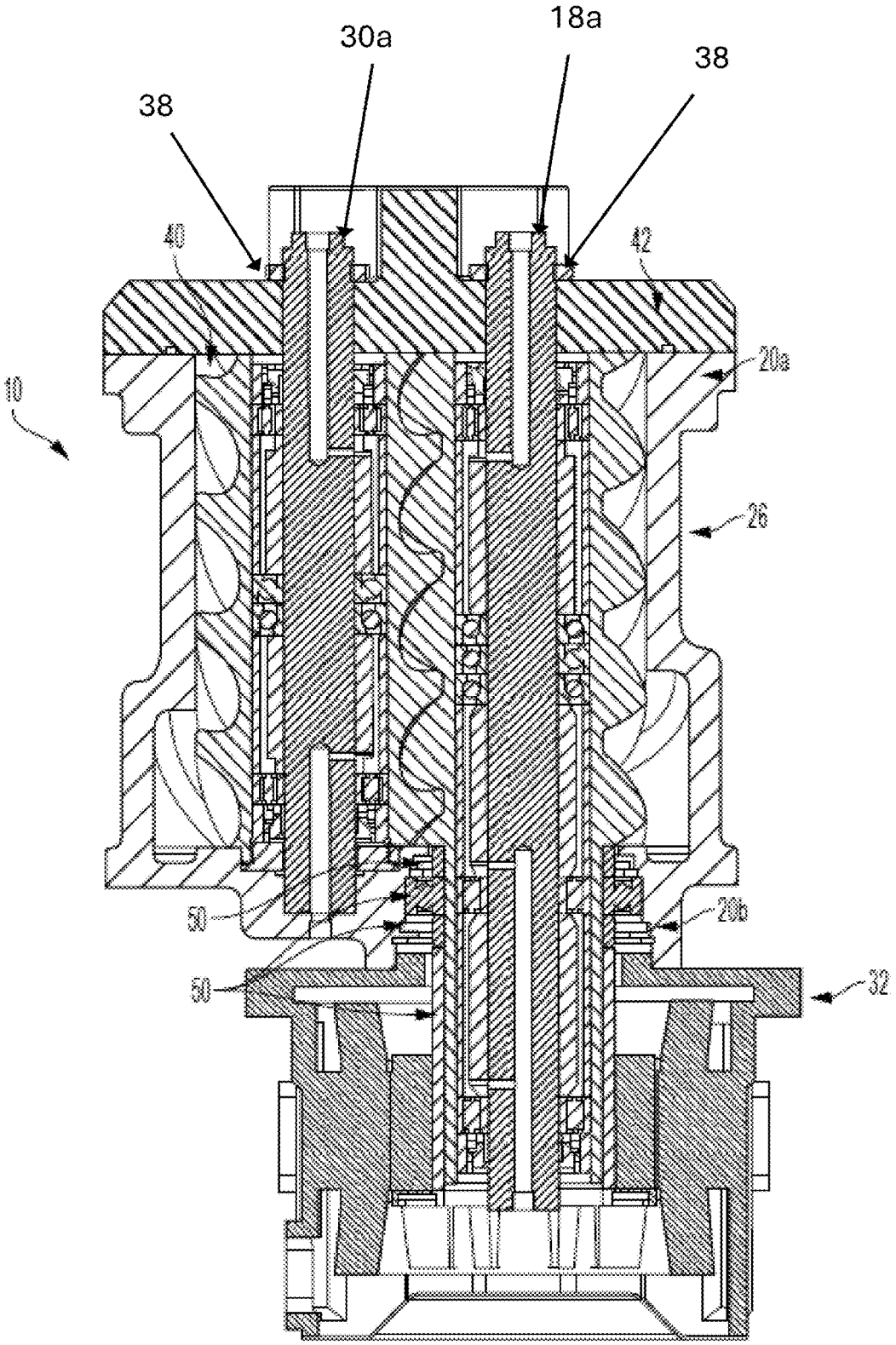
FIG. 1 is a cross-section of the compressor.
Figure 2:
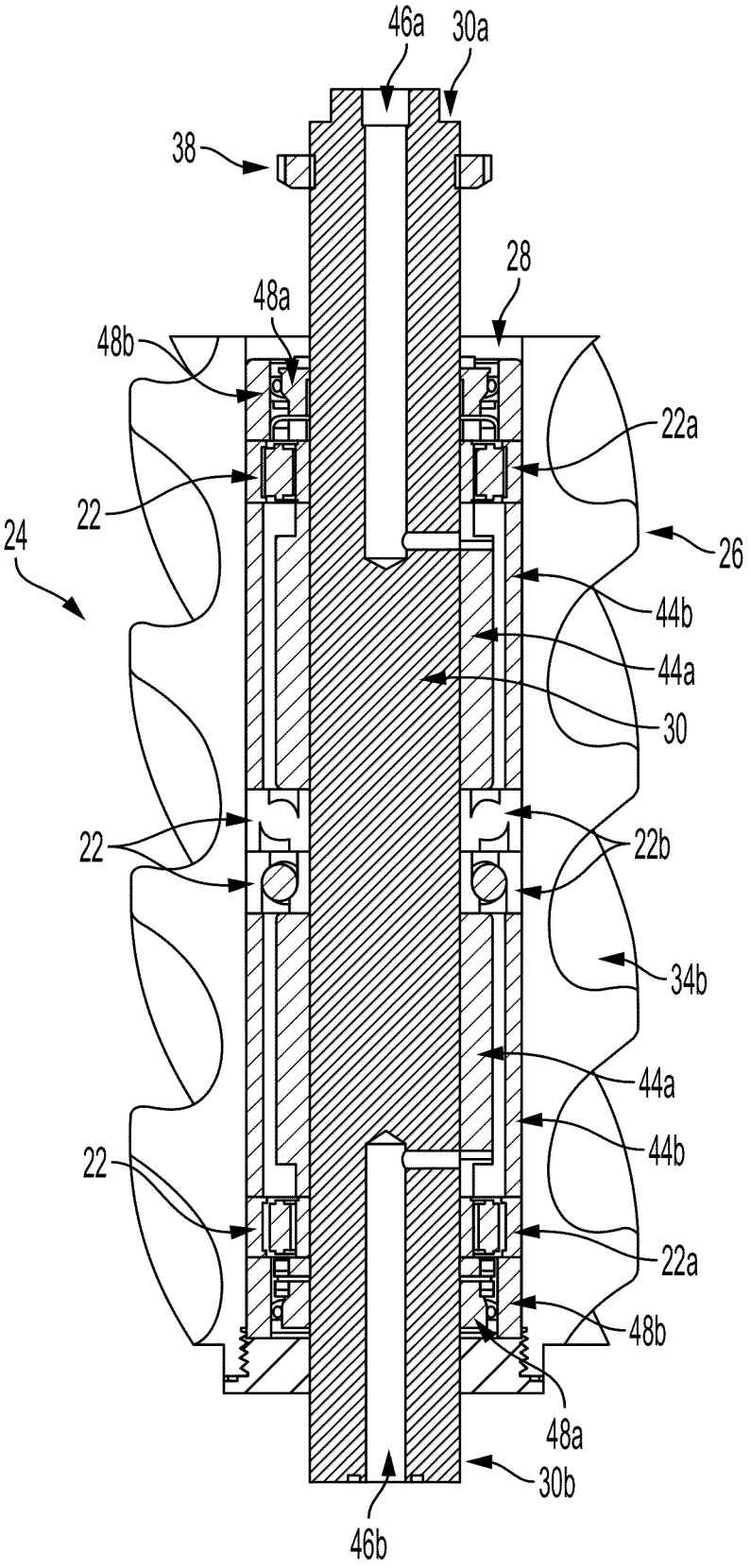
FIG. 2 is a cross-section of the female rotor.
Figure 3:
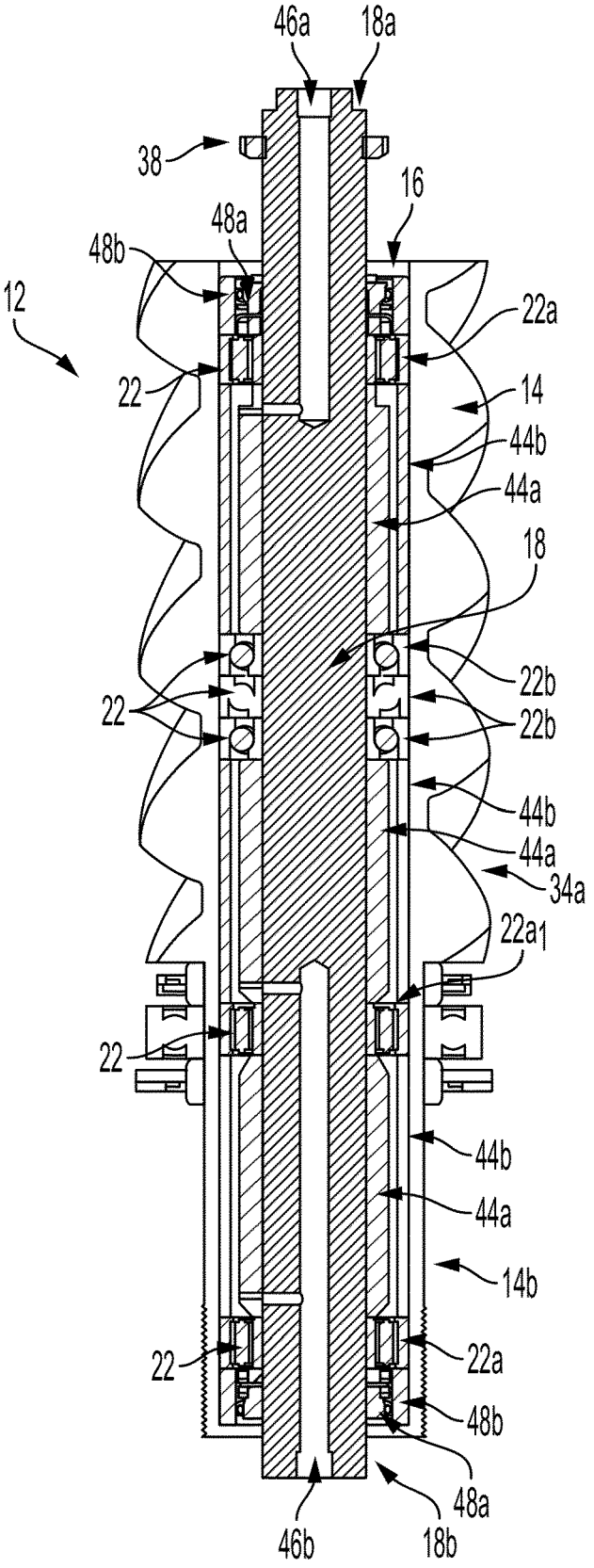
FIG. 3 is a cross-section of the male rotor.

Referring now to the drawings reference numeral 10 refers generally to a compressor which includes a male rotor assembly 12 including an elongate male helical-shaped rotor 14 having an axial cylindrical cavity 16 therethrough, a stationary shaft 18 axially aligned with the male rotor 14 and through the cavity 16, a housing 20 for housing the male rotor 14 and its associated stationary shaft 18 therein wherein the shaft 18 is fixed within the housing 20 for preventing rotation thereof relative to the housing 20, and bearing means 22 mounted within the cavity 16 of the male rotor 14 for bearing the friction between the rotor 14 and the shaft 18 as the male rotor 14 rotates about the stationary shaft 18. The compressor 10 also includes a female rotor assembly 24 including an elongate female helical-shaped rotor 26 having an axial cylindrical cavity 28 therethrough, which is in register with the male rotor 14, a stationary shaft 30 axially aligned with the female rotor 26 and through the cavity 28, wherein the housing 20 also houses the female rotor 26 and its associated stationary shaft 30 therein wherein the shaft 30 is fixed within the housing 20 for preventing rotation thereof relative to the housing 20, bearing means 22 mounted within the cavity 28 of the female rotor 26 for bearing the friction between the rotor 26 and the shaft 30 as the rotor 26 rotates about the stationary shaft 30, a drive means 32 for driving either the male 14 or female 26 rotor, and wherein the complementary helix formations 34*a*,34*b* define cavities between the male 34*a* and female 34*b* formations which capture, drive and compress a fluid substance (not shown) forward when the rotors 14,26 are driven.

The rotors 14,26 are manufactured from mild steel. It is to be appreciated that the rotors 14,26 are cast or machined. An end portion 14*a* of the male rotor 14 is configured to allow a driving means 32 to be mounted on the rotor 14. The driving means is in the form of a motor 32. It is to be appreciated that the motor 32 is mounted directly on the rotor 14 and there are no transmission losses.

The stationary shafts 18,30 are manufactured from mild steel.

The housing 20 is manufactured from steel. The housing 20 includes a fixing means 38 for fixing the shafts 18,30 to the housing 20. The fixing means 38 is configured to fix at least one end 18*a* of the male shaft 18 to the housing, such that the opposing free end 18*b* thereof may allow the corresponding rotor end 14*b* to be received by the motor 22. The fixing means 38 is in the form of a lock nut. The lock nut 38 is configured to allow axial adjustment of the shaft 18,30. It is to be appreciated that the housing 20 is cast or machined. The housing 20 defines an opening 40 at one end 20*a* thereof to receive the rotors 14,26 and shafts 18, 30 therein. The housing 20 defines an aperture (not shown) at an end 20*b* opposing the open end 20*a* thereof for allowing at least a portion of an end 14*b* of the male rotor 14 and shaft 18 to protrude therethrough, such that the motor 22 can be mounted thereon and it can be received by the motor 22, respectively. The housing 20 further includes a cover 42 for covering the rotors 14,26 and shafts 18,30 when received by the opening 40 defined by an end 20*a* of the housing 20. Securing means, such as bolts, are further provided for securing the cover 42 to the housing 20. The cover 42 defines a threaded aperture (not shown) therethrough for allowing the ends 18*a*,30*a* of the shafts 18,30, which is to be threadedly fixed to the housing 20, to protrude therethrough. The lock nut 38 fixes the ends 18*a*,30*a* of the shafts 18,30 protruding through the cover 42 to the cover 42. It is to be appreciated that the lock nut 38 is tightened and loosened for axial adjustment to adjust the interface clearance between the male 34*a* and female 34*b* formations, up to 20 micron which varies according to a diameter and length of the rotors 14,26, and to allow positioning of the rotors 14,26 in the housing 20 to be adjusted.

The bearing means 22 includes radial bearings 22*a* and axial thrust bearings 22*b*. The axial thrust bearings 22*b* are located in a middle portion of the rotor cavity 16,28 for preventing the rotor 14,26 from being displaced axially by suction forces. The radial bearings 22*a* are located at both ends of rotor cavity 16,28 for supporting the shaft 18,30 at its ends. A radial bearing 22*a*1 is also located at a portion within the rotor cavity 16 where an outer portion of the rotor 14 is seated in the housing 20. The bearings 22*a*,22*b*, 22*a*1 are spaced axially within the cavity 16,28 of the rotor 14,26 for bearing the friction between the rotor 14,26 and the shaft 18,30 along an axis thereof. It is to be appreciated that an inner portion (not shown) of the bearings 22*a*,22*b*, 22*a*1 is fixed to the stationary shaft 18,30 to prevent rotation thereof relative to the shaft 18,30 whereas an outer portion (not shown) of the bearings means 22*a*,22*b*, 22*a*1 is free to allow rotation thereof relative to the shaft 18,30.

Spacers 44 are mounted on the stationary shaft 18,30 in-between the bearings 22*a*,22*b*, 22*a*1. The spacers 44 are manufactured from steel. The spacers 44 include inner spacer members 44*a* and outer spacer members 44*b* which are coaxially aligned with one another. It is to be appreciated that the inner spacer members 44*a* are heat pressed onto the stationary shaft 18,30 to prevent rotation thereof about the shaft 18,30 and supports and stiffens the shaft 18,30 and rotor assembly 12,24 to lessen bending and to increase resistance to shear forces. It is to be appreciated that ends (not shown) of the bearings 22*a*,22*b*, 22*a*1 and ends (not shown) of the spacers 44 therebetween abutt and bear against one another to support the shaft 18,30 and rotor assembly 12,24.

A lubrication system (not shown) is in fluid flow communication with the bearings 22*a*,22*b*, 22*a*1. The lubrication system (not shown) includes a lubricant (not shown) and a lubrication channel 46*a*,46*b* defined by the shaft 18,30 which is in fluid flow communication with the bearings 22*a*,22*b*, 22*a*1 for directing the lubricant (not shown) towards the bearings 22*a*,22*b*, 22*a*1 for lubrication thereof. The lubricant (not shown) is in the form of ISO 67 grade lubricant. A lubrication channel 46*a*,46*b* is defined by both ends 18*a*, 18*b*,30*a*,30*b* of the shaft 18,30. The channels 46*a*,46*b* are in fluid flow communication with the bearings 22*a*,22*b*, 22*a*1. The lubrication channel 46*a* at one end 18*a*,30*a* of the shaft 18,30 is an inlet channel 46*a* allowing the ISO 67 grade lubricant (not shown) to flow into the rotor cavity 16,28 to lubricate the bearings 22*a*,22*b*, 22*a*1. The channel 46*b* at an opposing end 18*b*,30*b* of the shaft 18,30 is an outlet channel 46*b* allowing the ISO 67 grade lubricant (not shown) to be removed from the rotor cavity 16,28.

Seals 48 are mounted within the rotor cavity 16,28 for sealing the bearings 22*a*,22*b*, 22*a*1 and spacers 44 therein. The seals 48 are in the form of any suitable convention seal. An inner portion 48*a* of the seal 48 is fixed to the shaft 18,30 for preventing rotation thereof about the shaft 18,30. An outer portion 48*b* of the seal 48 rotates relative to the inner portion 48*a* of the seal 48 to allow the rotor cavity 16,28 to remain sealed as the rotor 14,26 rotates about the shaft 18,30. It is to be appreciated that the seals 48 prevent the ISO 67 grade lubricant (not shown) from leaking from the rotor cavity 16,28. It is to be appreciated that the seals 48 seal the ISO 67 grade lubricant (not shown) within the cavity 16,28 of the rotor 14,26 such that the ISO 67 grade lubricant ((not shown) does not come into contact and contaminate air (not shown) that is compressed. It is to be appreciated that the seals 48 also prevent the lubricant (not shown), preferably water, lubricating the rotors 14,26 in a compression chamber (not shown) of the compressor, from leaking into the rotor cavities 16,28.

A coupling arrangement 50 is mounted on an end 14*b* of the male rotor 14 protruding from the housing 20 which is sized, shaped and configured for receiving the end 18*b* of the shaft 18 therein, for coupling the motor 22 directly to the rotor 14.

It is to be appreciated that surfaces of the rotor assemblies 12,24 are plated with a nickel composition to protect the surfaces against corrosion caused by water or abrasion thereof by abrasive foreign materials. It is to be appreciated that it is an electroless process.

It is, of course, to be appreciated that the compressor 10 in accordance with the invention is not limited to the precise constructional and functional details as hereinbefore described with reference to the accompanying drawings and which is varied as desired.

Although only certain embodiments of the invention have been described herein, it will be understood by any person skilled in the art that other modifications, variations, and possibilities of the invention are possible. Such modifications, variations and possibilities are therefore to be considered as falling within the spirit and scope of the invention and hence form part of the invention as herein described and/or exemplified. It is further to be understood that the examples are provided for illustrating the invention further and to assist a person skilled in the art with understanding the invention and is not meant to be construed as unduly limiting the reasonable scope of the invention.

The inventor believes that the compressor 10 in accordance with the present invention is advantageous in that it has a higher efficiency than other known rotors. The rotor assemblies 12,24 also experience less bending than other known rotors because of the fact that the rotor 14,26 rotates about the shaft 18,30. Another advantage is there are no transmission losses as the motor 22 is directly mounted on the rotor 14 by a coupling arrangement 50. Using water as a lubricant (not shown) for the rotors in the compression chamber is advantageous because it allows the rotor assemblies 12,24 to run at lower operating temperatures. A further advantage is that the enclosed lubrication system (not shown) allows the rotating parts to be effectively lubricated, thus resulting in no wear on the parts of the rotor assemblies 12,24 that rotate. The enclosed lubrication system (not shown) is also less sensitive to an increase in the pH values of the water, due to pollution of the air that is sucked in by the rotor assemblies 12,24, thus no filtration system is required to filter and reduce the pH of the water (not shown). The hollow rotor 14,26 has a lower rotor backlash and also allows for clearances between the rotor 14,26 and the housing 20 and cover 42. The bearings 22 and spacers 44 which are mounted within the hollow rotor 14,26 allows for significantly less rotor bending by providing support for the shaft 18,30. The compressor 10 in accordance with the present invention also has an expected lifetime which is twice to three times as long as present oil-free compressors.

The invention claimed is:

1. A compressor comprising:

a male rotor assembly which comprises:

an axially adjustable elongate male helical-shaped rotor having a first axial cylindrical cavity therethrough;

an axially adjustable first stationary shaft axially aligned with the male helical-shaped rotor and through the first axial cylindrical cavity; and a first bearing assembly rotationally connecting the first axial cylindrical cavity and male rotor, the first bearing assembly comprising first radial bearings and first axial thrust bearings with the first radial bearings mounted inside the first axial cylindrical cavity at each end thereof and with the first axial thrust and/or bearings mounted in a middle portion of the first axial cylindrical cavity;

a housing for housing the male helical-shaped rotor and the housing also rotationally fixes the first stationary shaft within a first housing cavity of the housing;

a female rotor assembly which comprises:

an axially adjustable elongate female helical-shaped rotor having a second axial cylindrical cavity therethrough, which is in register with the male helical-shaped rotor;

an axially adjustable second stationary shaft axially aligned with the female helical-shaped rotor and through the second axial cylindrical cavity; and a second bearing assembly rotationally connecting the second axial cylindrical cavity and female rotor, the second bearing assembly comprising second radial bearings and second axial thrust bearings with the second radial bearings mounted inside the second axial cylindrical cavity at each end thereof and with the second axial thrust and/or radial bearings mounted in a middle portion of the second axial cylindrical cavity;

wherein the housing also houses the female helical-shaped rotor and the housing also rotationally fixes the second stationary shaft in a second housing cavity within the housing;

wherein the housing defines an aperture at an end for allowing at least a portion of an end of either the male helical-shaped rotor or the female helical-shaped rotor and its associated shaft to protrude there through, such that a driving means can be mounted on the end of the male helical-shaped rotor or the female helical-shaped rotor or be received by the driving means;

wherein the driving means is coupled to either the male helical-shaped rotor or the female helical-shaped rotor; and wherein the male helical shaped rotor and the female helically shaped rotor define working cavities therebetween which capture, drive and compress a fluid substance forward when the male helical-shaped rotor and the female helical-shaped rotor are driven.

2. A compressor as claimed in claim 1 wherein the housing includes lock nuts for axially adjustably fixing the first and second stationary shafts to the housing, which the lock nuts are configured to adjustably fix one end of each of the first and second stationary shafts to the housing, such that the opposing free end thereof can be received by the driving means.

3. A compressor as claimed in claim 1 wherein the housing defines an opening opposite the aperture to receive the first stationary shaft, the second stationary shaft, the male helical-shaped rotor and the female helical-shaped rotor therein.

4. A compressor as claimed in claim 3 wherein the housing comprises a cover for covering the first stationary shaft, the second stationary shaft, the male helical-shaped rotor and the female helical-shaped rotor when received by the opening defined by an end of the housing.

5. A compressor as claimed in claim 1 wherein the first and second axial thrust bearings are located in the first axial cylindrical cavity and second axial cylindrical cavity respectively and wherein the lock nuts allow axial adjustment and lock into position the male helical-shaped rotor and the female helical-shaped rotor.

6. A compressor as claimed in claim 1 wherein the first radial bearings are located at both ends of first axial cylindrical cavity for supporting the first stationary shaft at its ends.

7. A compressor as claimed claim 1 wherein the first radial bearing is located at a portion within the first axial cylindrical cavity where an outer portion of the male helical-shaped rotor is seated in the housing.

8. A compressor as claimed in claim 1 wherein the first and second radial bearings are spaced axially within the first axial cylindrical cavity and the second axial cylindrical cavity respectively.

9. A compressor as claimed in claim 1 wherein spacers are mounted on the first stationary shaft in-between the first radial bearings and the first axial thrust bearings, and the second stationary shaft in-between the second radial bearings and the second axial thrust bearings.

10. A compressor as claimed in claim 1 wherein a lubrication system is in fluid flow communication with the first bearing assembly and the second bearing assembly, inside the respective first and second axial cylindrical cavities, which the lubrication system comprises a lubricant and a lubrication channel defined by both ends of the first stationary shaft and the second stationary shaft and a corresponding, an inlet and outlet respectively, which is in fluid flow communication with first bearing assembly and the second bearing assembly, inside the respective first and second axial cylindrical cavities.

11. A compressor as claimed in claim 10 wherein seals are mounted within the first axial cylindrical cavity and the second axial cylindrical cavity for sealing the first bearing assembly respectively and the second bearing assembly respectively and wherein an inner portion of a first seal of the seals is fixed to the first stationary shaft for preventing rotation thereof about the first stationary shaft and an outer portion of the first seal to rotate relative to the inner portion of the first seal to allow the first axial cylindrical cavity to remain sealed as the male helical-shaped rotor rotates about the first stationary shaft, and wherein an inner portion of a second seal of the seals is fixed to the second stationary shaft for preventing rotation thereof about the second stationary shaft and an outer portion of the second seal to rotate relative to the inner portion of the second seal to allow the second axial cylindrical cavity to remain sealed as the female helical-shaped rotor rotates about the second stationary shaft.

12. A compressor as claimed in claim 1 wherein a coupling arrangement is mounted on an end of the first male helical-shaped rotor protruding from the housing which is sized, shaped and configured for receiving the end of the male helical-shaped rotor therein, for coupling the driving means directly to the male helical-shaped rotor; or wherein a coupling arrangement is mounted on an end of the female helical-shaped rotor protruding from the housing which is sized, shaped and configured for receiving the end of the female helical-shaped rotor therein, for coupling the driving means directly to the female helical-shaped rotor.

13. The compressor as claimed in claim 1, wherein another first radial bearing is mounted in a middle portion of the first axial cylindrical cavity, and another second radial bearing is mounted in a middle portion of the second axial cylindrical cavity.

* * * * *